United States Patent [19]

Sovis et al.

[11] Patent Number: 4,547,206

[45] Date of Patent: Oct. 15, 1985

[54] VACUUM CLEANER

[75] Inventors: John F. Sovis, Coldwater, Mich.; John A. Balch, Bay Village, Ohio

[73] Assignee: Royal Appliance Mfg. Co., Highland Heights, Ohio

[21] Appl. No.: 506,727

[22] Filed: Jun. 22, 1983

[51] Int. Cl.[4] ..... B01D 47/02

[52] U.S. Cl. ..... 55/255; 55/257 PP; 55/276; 15/353

[58] Field of Search ..... 15/326, 353; 55/244, 55/248, 255, 256, 276, 246, 257 PP

[56] References Cited

U.S. PATENT DOCUMENTS

| | | | |
|---|---|---|---|
| 2,221,572 | 11/1940 | Brock et al. | 55/248 |
| 2,539,867 | 1/1951 | Schnabel | 55/255 X |
| 2,673,619 | 3/1954 | Martin | 15/353 X |
| 2,945,553 | 7/1960 | Brock | 55/248 |
| 2,954,095 | 9/1960 | Brock | 55/255 X |
| 3,234,713 | 2/1966 | Harper et al. | 55/246 |
| 3,286,444 | 11/1966 | Boswinkle et al. | 55/255 X |
| 3,650,093 | 3/1972 | Rosenberg | 55/159 |
| 4,226,575 | 10/1980 | Hyatt et al. | 417/423.1 |
| 4,330,899 | 5/1982 | Miller et al. | 15/326 |

FOREIGN PATENT DOCUMENTS

| | | | |
|---|---|---|---|
| 0688337 | 6/1964 | Canada | 15/353 |

*Primary Examiner*—Charles Hart

*Attorney, Agent, or Firm*—Fay, Sharpe, Fagan, Minnich & McKee

[57] ABSTRACT

A vacuum cleaner including a bypass-type blower motor in association with a water filter is provided. Motor and working air noise is muffled by the inclusion of a baffle ring extending between upper and lower motor support assemblies and about the fan chamber for generating working air. The baffle ring includes an exhaust port spaced 180° from the working air exhaust port of the cleaner to provide a tortuous working air exhaust air flow pattern which reduces noise from the cleaner. A water separator element is provided in association with the water filter pan to separate and condense water and dirt particles intermixed with working air sucked by the cleaner. The water separator element includes an air-porous portion and a generally water non-porous portion for separating water from the working air. The air-porous portion faces generally away from an inlet port to the water pan.

15 Claims, 5 Drawing Figures

VACUUM CLEANER

BACKGROUND OF THE INVENTION

The present invention relates to the vacuum cleaner art and more particularly to vacuum cleaners employing a water filter.

The invention is particularly applicable to a vacuum cleaner employing a bypass type blower motor in association with a water pan, separator and filter assembly. However, it will be appreciated to those skilled in the art that the invention could be readily adapted for use with other types of vacuum cleaners or other types of devices.

Conventional vacuum cleaners employing a water filter are known but have suffered the problems resulting from unreliable water filtration, excessive water filter turbulence and water contamination of the motor bearing elements over a period of time. It is important for the working air in a water filtration system to pass through a sufficient amount of water to draw off the dirt particles from the dirty working air. Where the dirty working air passes through an inadequate amount of water, the dirt particles are merely transmitted through the system in association with the uncleaned working air. Inadequate water passage has occurred through design limitations or through excessive turbulence of the water which created air passageways through the water. Excessive and uncontrolled turbulence can also cause excited impingement of water splashes against the cleaner motor and bearings with consequential harm occurring to such elements.

Another common problem in vacuum cleaner construction is the undesirably high level of noise made by the cleaner during operation from the cleaner motor, the cleaner vacuum fans and the resulting noise from turbulent working air. A variety of baffle arrangements have been suggested and employed in the industry, see U.S. Pat. No. 4,330,899, to reduce the noise level, all with varying degrees of success.

The present invention contemplates a new and improved vacuum cleaner construction which overcomes all of the above referred to problems and others to provide a new vacuum cleaner construction which is simple in design, economical to manufacture, provides improved noise reduction, provides improved protection of the motor and bearing elements against water and contaminants during operation, provides improved water separation operation from working air and which provides improved and controlled operation of water turbulence and working air operation.

BRIEF SUMMARY OF THE INVENTION

In accordance with the present invention, there is provided a vacuum cleaner construction comprising a upper housing and a lower housing. The upper housing includes a side wall and a top dome, a bypass type blower motor having a fan chamber for generating working air, a working air inlet port and a working air outlet port, a lower motor support assembly and an upper motor support assembly. The lower motor support assembly includes a lower mounting plate facing the lower housing. The upper housing further includes a baffle ring extending between the upper and lower motor support assemblies and about the fan chamber and has a working air exhaust port. The upper housing side wall includes a working air outlet aperture spaced 180° from the baffle ring exhaust port. The fan chamber includes a main bearing supporting a fan shaft, a sealing air fan mounted to the shaft, a sealing baffle ring about the fan shaft being spaced slightly from the fan shaft for air passage therebetween and further being spaced from the main bearing. The sealing baffle ring is generally contiguous to the sealing air fan. A sealing air inlet port is disposed apart from the working air inlet and outlet ports whereby upon operation of the sealing air fan the main bearing is air pressure sealed against the working air. The lower housing includes a separator element and a bottom pan assembly mounted to a lower housing dolly assembly. The bottom pan assembly includes a working air inlet aperture and a associated deflector. The upper housing and lower housing include mating rim portions for sealing clamped engagement therebetween.

In accordance with another aspect of the present invention a plurality of spaced radially-extending baffle plates are interposed between the upper housing side wall and the baffle ring.

In accordance with another aspect of the present invention, the separator element includes a screen portion for filtering an condensing water and working air contaminants from the working air. The separator element is of a generally frusto-conical configuration. The screen portion faces away from the air inlet aperture and associated deflector.

In accordance with yet another aspect of the present invention, the deflector includes a side wall depending from the bottom pan assembly and a bottom wall depending from the side wall and the bottom pan assembly. The bottom wall includes a working air outlet port for communicating the workig air to the bottom pan assembly. The bottom wall is configured to direct the working air from the deflector bottom wall air outlet port through the water of the bottom pan assembly over the extent of the bottom wall.

One benefit obtained by use of the present invention is a vacuum cleaner construction which has reduced operational noise.

Another benefit obtained from the present invention is a vacuum cleaner which employs an improved water separator element for separating and condensing water from working air.

Yet another advantage of the present invention is a water filter vacuum cleaner which controls water turbulence and resulting water contamination of cleaner motor bearing elements over a period of time.

Other benefits and advantages of the subject new vacuum cleaner construction will become apparent to those skilled in the art upon a reading and understanding of this specification.

BRIEF DESCRIPTION OF THE DRAWINGS

The invention may take physical form in certain parts and arrangements of parts, the preferred embodiment of which will be described in detail in this specification and illustrated in the accompanying drawings which form a part hereof and wherein.

DETAILED DESCRIPTION OF THE INVENTION

Figure 1:
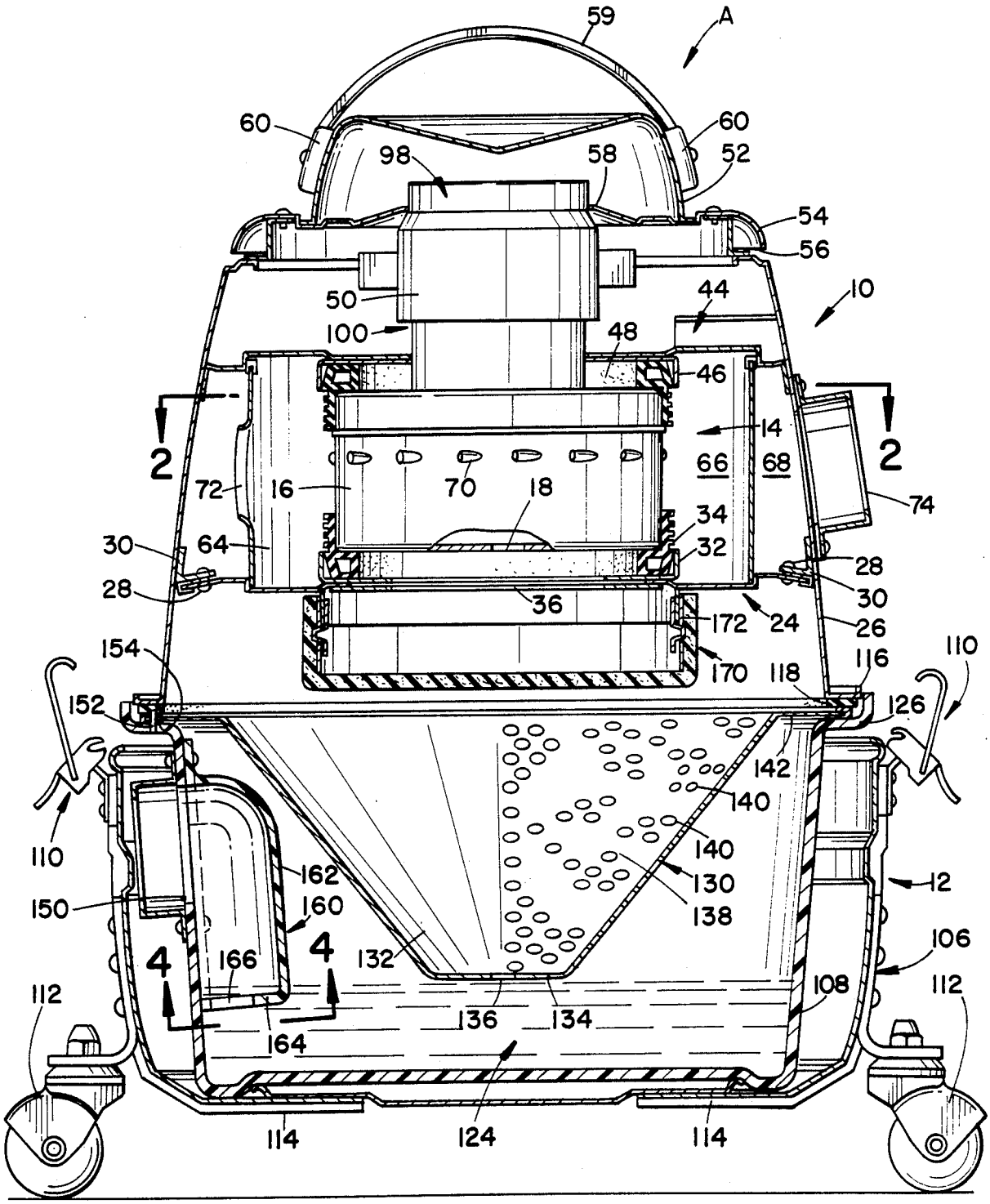
FIG. 1 is a cross-sectional view of a vacuum cleaner formed in accordance with the present invention showing a water level in the bottom pan assembly.

Referring now to the drawings wherein the showings are for purposes of illustrating the preferred embodiment of the invention only and not for purposes of limiting the same, the FIGURES show a vacuum cleaner A employing a primary water filter for cleaning air and collecting dirt materials into a water tank or pan receptacle.

More specifically, and with reference to FIG. 1, vacuum cleaner A comprises an upper housing 10 and a lower housing 12. The upper housing 10 contains a bypass-type blower motor assembly 14 including a fan chamber 16 and a working air inlet port 18 to the fan chamber 16. The motor assembly 14 is supported on a lower mounting plate assembly 24 fastened to the side wall 26 of the upper housing 10 with a plurality of fasteners 28 and brackets 30. The lower mounting plate assembly 24 includes an annular flanged member 32 which is sealingly engaged to annular lower sealing gasket 34. The flanged number 32 and sealing gasket 34 in turn support the fan chamber 16 and ultimately the motor assembly 14. The lower mounting plate assembly 24 includes an inner opening 36 for the communication of working air from the lower housing 12 to the upper housing 10.

Upper mounting plate assembly 44 is of a similar construction to the lower mounting plate assembly and is fastened to the side wall 26. It includes an upper annular flanged member 46 in sealing engagement to upper sealing gasket 48. The motor 50 of motor assembly 14 extends through the upper mounting plate assembly 44 into the dome 52 of the upper housing 10. A cover ring 54 is interposed between the dome 52 and the side walls 26 of the upper housing and includes an annular opening 56 for the egress of motor cooling air as will hereinafter be more fully explained. The cover ring radially innermost edged portions 58 are substantially air-sealed against the motor 50 to segregate motor cooling air intake from the motor cooling air exhaust. The motor cooling air intake is communicated through an inlet port (not shown) in the dome 52. Handle 59 is fastened to the dome 52 with fasteners 60 for facilitating transport of the vacuum cleaner A.

Figure 2:
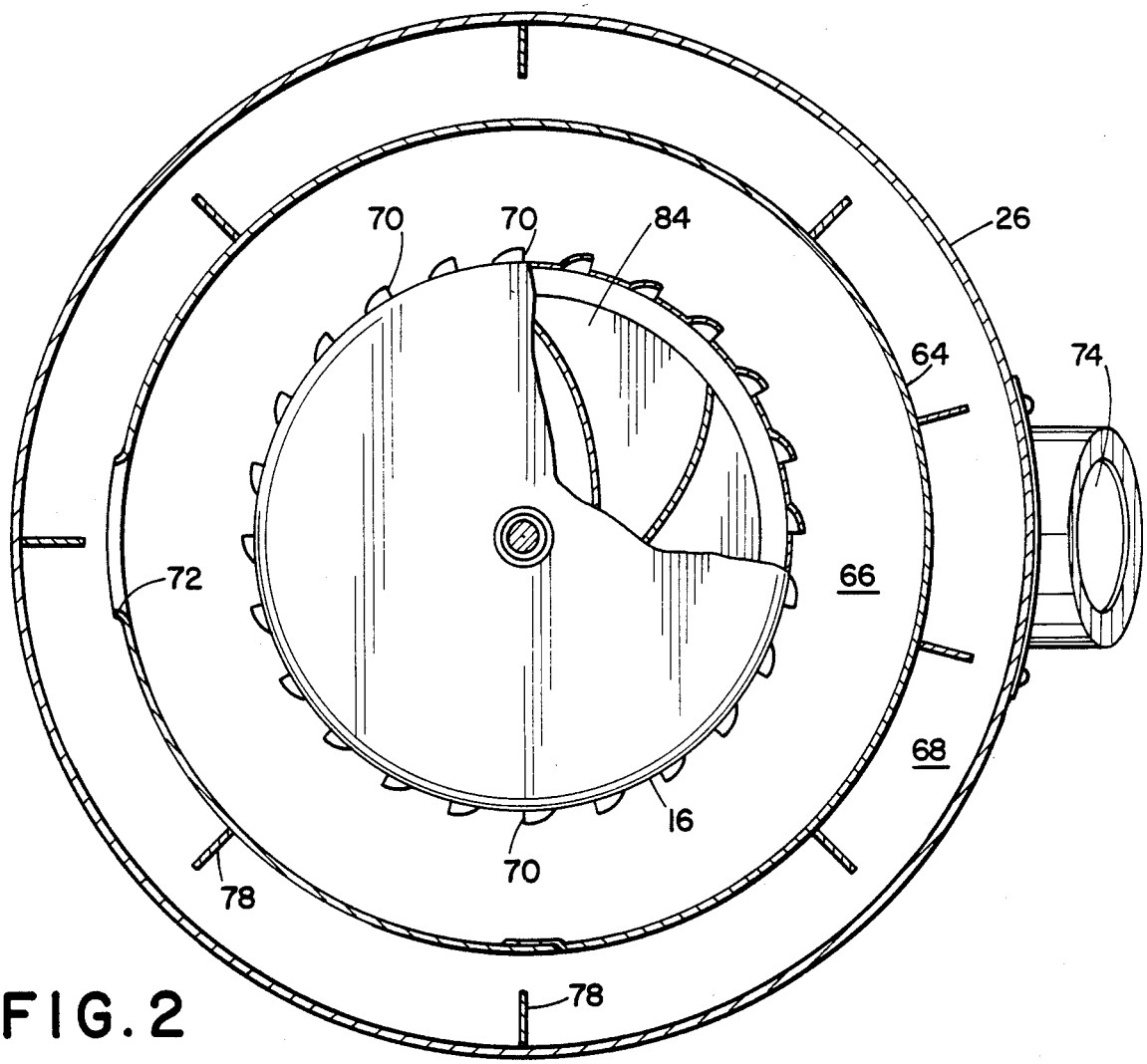
FIG. 2 is a cross-sectional view taken along line 2—2 of FIG. 1 particularly showing the configuration of a baffle ring.

With continued reference to FIG. 1, and with reference to FIG. 2, a baffle ring 64 is radially interposed between fan chamber 16 and upper housing side wall 26. The baffle ring extends from the lower mounting plate assembly 24 to the upper mounting plate assembly 44 to define a first air chamber 66 about the fan chamber 16 and a second air chamber 68 adjacent the side wall 26 of the upper housing. The baffle ring provides a tortuous working air exhaust flow pattern from the fan chamber 16 to provide for noise reduction in the operation of the vacuum cleaner A. Working air exhausted from the plurality of fan chamber exhaust ports 70 is immediately communicated into the first air chamber 66. A single baffle ring working air outlet port 72 communicates working air from the first air chamber 66 to the second air chamber 68. The baffle ring outlet port 72 is spaced 180° from the ultimate working air outlet port 74 of the cleaner A to maximize working air flow travel distance from the first air chamber 66 to the second air chamber 68 and out from the cleaner A. It is within the scope of the invention to include a plurality of spaced radially extending baffle plates 78, a first portion of which depend from the side wall 26 and a second portion of which depend from the baffle ring 64. The baffle plates further provide tortuous air flow patterns for noise reduction in the operation of the cleaner A.

Figure 3:
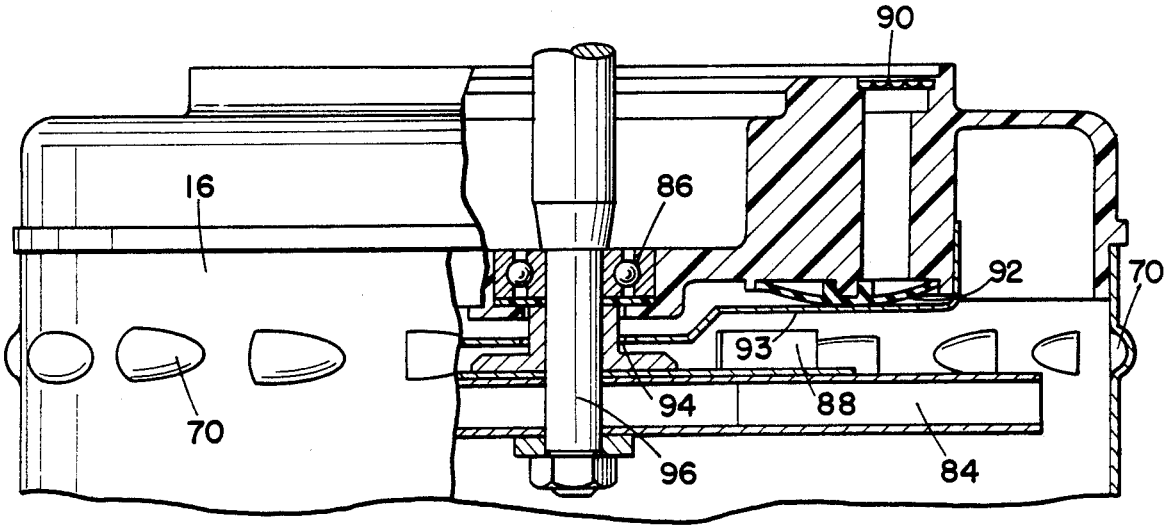
FIG. 3 is a partial cross-sectional view of a section of a motor of the present invention particularly illustrating the air pressure sealing of the bearings of the motor against water contamination.

The subject cleaner employs a dynamic air seal to better seal the fan bearings and motor against moisture and contaminats that may be intermixed with the working air during operation of the cleaner. The operation of the air seal shown in FIG. 3 is more particularly identified in U.S. Pat. No. 4,226,575. In general operation, a working air fan 84 draws working air through the fan chamber working air inlet port 18 (FIG. 1) and out the fan chamber exhaust ports 70. To keep the working air away from the bearings 86 of the fan drive, a sealing air fan 88 draws air from sealing air inlet port 90, about check valve 92 along sealing air baffle ring 93 and through the sealing air port 94 which is slightly spaced from the fan drive 96. The sealing air exhaust is similarly expelled through exhaust ports 70. The air pressure seal at sealing air port 94 during operation of the fans 84, 88 effectively seals the bearing 86 and the motor against the working air sucked into the fan chamber 16 by working air fans 84.

With particular reference to FIGS. 1 and 3, the subject vacuum cleaner A includes a bypass-type fan motor assembly having a fan engaged to the fan drive separate from the main working air fans in the fan chamber 16 for blowing cooling air over the motor. The motor cooling air flow is kept separate from the working air flow passing through the fan chamber 16. The cooling air for the motor 50 is drawn in through the dome 52 through a cooling air inlet port (not shown) in the side wall of the dome. A fan (not shown) is typically positioned in the top portion such as indicated at 98 in the motor 50 to draw air in from the dome 52 and is expelled out through the motor through ventilating ports spaced in the motor such as indicated at 100. The cooling air is then ultimately expelled through the annular opening 56 in the cover ring 54.

Figure 4:
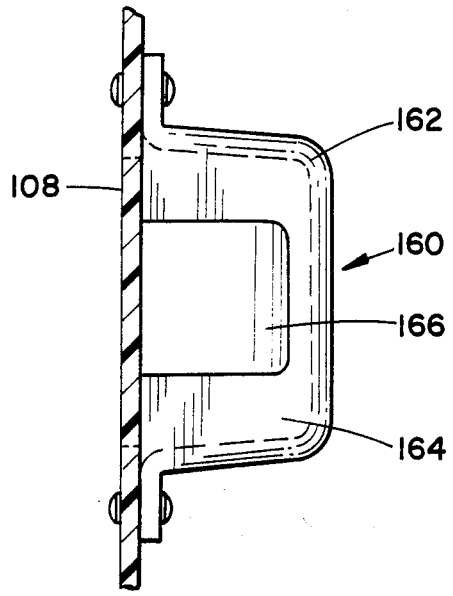
FIG. 4 is a cross-sectional view taken along line 4—4 of FIG. 1 particularly showing the bottom wall and the bottom wall air outlet port of the working air deflector of the bottom pan assembly; and, FIG. 5 is a plan view of a water separator element formed in accordance with the present invention.
Figure 5:
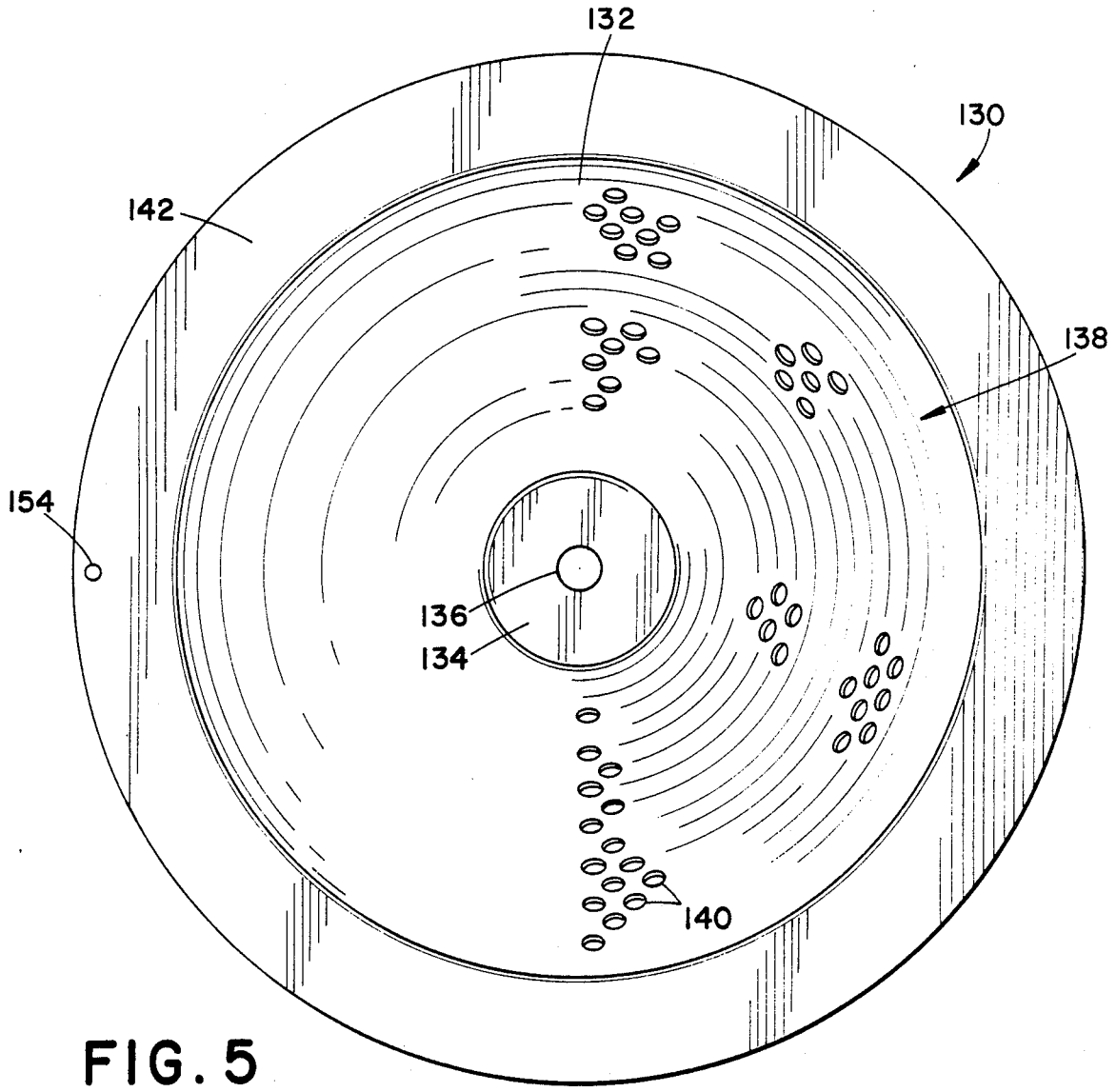

With particular reference to FIGS. 1, 4 and 5, the dirt filtration and cleaning operation of the invention will now be particularly discussed. The lower housing 12 includes a dolly assembly 106 for supporting a water pan 108 and for clamping attachment and support of the upper housing 10 through a plurality of clamps 110. The clamps 110 engage a clamping flange 116 depending from the side wall 26 of the upper housing 10 for selective attachment of the lower housing to the upper housing. A sealing gasket 118 facilitates water and air sealing of the upper housing to the lower housing. The dolly assembly further includes casters 112 for rolling support of the vacuum cleaner and support legs 114 for supporting the water pan 108.

The water pan 108 is preferably of a clear plastic material such that the water 124, and more particularly the water level, may be viewed by an operator of the cleaner. The pan includes a flanged rim portion 126 which cooperates with sealing gasket 118, upper housing flange 116, and clamp 110 to facilitate sealing of the upper housing to the lower housing.

A water separator element 130 is provided in the lower housing 12 to separate and condense water from the working air during operation of the cleaner. During such operation the working air is passed through the water 124 and quite a bit of water turbulence occurs in the pan water chamber. The separator element 130 facilitates separation and condensation of water from working air and filtration of contaminants from the working air. The separator element is preferably constructed of a durable and long-lasting material such as aluminum although it is within the scope of the invention to include other materials such as plastics as the construction material. It is of a generally frusto-conical configuration including a sloping side wall 132 which tapers towards the bottom of the water pan 108. A bottom wall 134 defines the bottom end portion of a separator element 130 and includes a water outlet aperture or drain hole 136 for the communication of water condensed within the separator element or along the side wall 130. The drain hole is preferably sized to have a one quarter inch diameter. The bottom wall is positioned at the water level in the pan. The side wall 132 includes a water-porous portion and a water non-porous portion. The water-porous portion is illustrated as a screen portion 138 including a plurality of stamped or punched holes 140 having an eighth of an inch diameter. The screen portion 138 communicates filtered working air from the water chamber towards the fan chamber 16. In the preferred embodiment, thirty one rows of holes 140 extend through a 180° segment of the side wall 130 from the bottom wall 134 towards the side wall flange 142. It is preferable that the screen portion is spaced away from the working air inlet port 150 of the bottom pan 108 as the area of greatest water turbulence occurs immediately adjacent the working air inlet port 150. The non-porous portion of the separator element generally faces towards the working air inlet port 150 to minimize passage of water through the separator element caused by violent water turbulence. Positioning of the water separator element 130 relative to the bottom pan 108 is facilitated by a locator device such as mating and locating pin 152 extending from the flanged rim portion 126 of the water pan which is received in the bore 154 in the separator flange 142. By these means, positioning of the separator element 130 in the preferred position is accomplished.

The water pan further includes a deflector element 160 which deflects the working air from the working air inlet port 150 and directs it to the water 124 contained in the water pan. The deflector includes a side wall 162 depending from the water pan 108 and may be integrally formed in the water pan or fastened as a separate element as illustrated in FIGS. 1 and 4. The deflector element side wall 162 deflects the working air towards the deflector element bottom wall 164 which is preferably positioned below the water level in the water pan. The bottom wall includes an opening 166 intermediately disposed in the bottom wall 164 which communicates the working air from the air inlet aperture 150 to the water of the water pan. It may be seen that the bottom wall 164 provides a shelf portion over which working air must pass before passage out of the water and through the separator element. It is through the passage across the shelf portion of the bottom wall 164 that the working air is drawn through the water and primarily washed. The inclusion of a shelf portion in the deflector element 160 provides improved washing over deflector elements which do not include a bottom wall and only provide washing as working air passes about the bottom edge of the side wall of a deflector element. It has been found that such minimal washing provides undesirable results particularly where excessive turbulence may allow dirty working air to pass to the separator element without passage through the water of the water pan.

The invention also includes a secondary filtration system for filtering dirty working air containing elements, such as ash, which cannot be picked up by water. Secondary filter 170 comprises a washable type filter element which is air-porous to allow communication of working air to the fan chamber 16. It is mounted on an annular receiving member 172 depending from the lower mounting plate assembly 24. The secondary filter element may be mounted to the receiving member 172 in a number of conventional ways such as by an elastomeric band (not shown) or by compression fitting the filter to the receiving member.

OPERATION

With particular attention to FIG. 1, the improved operational characteristics of the new vacuum cleaner will be specifically discussed.

The invention has a triple filtration system for dirty working air. Water 124 is provided in the pan 108 to a preselected level just below the bottom wall 134 of the separator element 130 and above the bottom wall 164 of the deflector 160. Dirty working air sucked in through the working air inlet port 150 of the water pan 108 is initially filtered in the water 124 of the water pan. Those elements that are picked up by water such as dust and most other types of elements picked up by a vacuum cleaner, are filtered from the working air in this filtration step. During operation, the water 124 is quite turbulent and impinges against the separator element 130 which primarily functions to separate and condense water particles from the working air and prevents splashing of water towards the upper housing, but also operates as the second dirt filtration system. The area of the plurality of holes 140 in the screen portion is important in that it may not be so limited as to affect the velocity of the air flow through the screen portion. As available area for passage is lessened, the velocity of air flow therethrough must increase. In the preferred embodiment of the invention, the open area of the holes of the screen portion is 19.35 sq. inches and air flow through the separator is 63 cubic ft./minute. The third filtration system comprises the secondary filtering element 170 which filters those elements not previously filtered by water and the separator element 130. Air flow is controlled in part by the size of the working air inlet port 18 of the fan chamber 16. In the preferred embodiment, the working air inlet port 18 has been reduced to a seven-eights of an inch round aperture to regulate the volume of air being drawn through the system to a preselected level facilitating efficient performance. By the time the working air has entered the working air inlet port 18 it has been cleaned and is ready for communication back to the environment of the cleaner. The working air is drawn up through the fan chambers 16 and is expelled through fan chamber ports 70 into the first air chamber 66 then out through the baffle ring outlet port 72 into the second air chamber 68 and ultimately out through the working air outlet port 74 of the cleaner.

The invention has been described with reference to the preferred embodiment. Obviously, modifications and alterations will occur to others upon the reading and understanding of the specification. It is my intention to include all such modifications and alterations insofar as they come within the scope of the appended claims or the equivalents thereof.

Having thus described my invention, I now claim:

1. A vacuum cleaner construction comprising an upper housing and a lower housing, said upper housing including a side wall and a top dome, a bypass type blower motor having a fan chamber for generating working air, a working air inlet port and a working air outlet port, a lower motor support assembly and an upper motor support assembly, said lower motor support assembly including a lower mounting plate facing said lower housing; said upper housing further including a baffle ring extending between said upper and lower motor support assemblies and about said fan chamber and having a working air exhaust port; said side wall including a working air outlet aperture spaced 180° from said baffle ring exhaust port, said fan chamber including a main bearing supporting a fan shaft, a sealing air fan mounted to said shaft, a sealing baffle ring about said fan shaft being spaced slightly from said fan shaft for air passage therebetween and further being spaced from said main bearing, said sealing baffle ring being generally contiguous to said sealing air fan, and a sealing air inlet port disposed apart from said working air inlet and outlet ports whereby upon operation of said sealing air fan said main bearing is air pressure sealed against the working air;

said lower housing including a separator element and a bottom pan assembly mounted to a lower housing dolly assembly, said bottom pan assembly including a working air inlet aperture and an associated deflector, said separator element being generally interposed between said bottom pan assembly and said fan chamber;

said upper housing and said lower housing including mating rim portions for sealing clamped engagements therebetween, whereby upon operation of said vacuum cleaner, noise from said motor, fan and separator is reduced, and said main bearing is protected against working air contaminants.

2. The vacuum cleaner construction as claimed in claim 1 wherein said baffle ring defines a first air chamber about said fan chamber for receiving working air exhaust from said fan chamber and a second air chamber adjacent said side wall of said upper housing for receiving working air exhaust from said first chamber, said upper housing including a plurality of spaced radially-extending baffle plates interposed between said side wall and said baffle ring.

3. The vacuum cleaner construction as claimed in claim 1 wherein said separator element includes a screen portion for filtering and condensing water and working air contaminants from the working air.

4. The vacuum cleaner construction as claimed in claim 3 wherein said separator element is of a generally frusto-conical configuration having a bottom wall, a sidewall, and a sidewall flange, said sidewall including said screen portion.

5. The vacuum cleaner construction as claimed in claim 4 wherein said screen portion faces generally away from said air inlet aperture and associated deflector.

6. The vacuum cleaner construction as claimed in claim 5 wherein said separator element includes a non-porous portion in said sidewall generally facing said air inlet aperture and associated deflector.

7. The vacuum cleaner construction as claimed in claim 4 wherein said separator element bottom wall includes a water outlet port for the egress of water received on said screen portion.

8. The vacuum cleaner construction as claimed in claim 4 wherein said separator element sidewall flange and at least one of said rim portions includes a mating and locating bead and receiving bore for positioning said separator element relative to said lower housing in a preselected position whereby said screen portion faces generally away from said air inlet aperture and associated deflector.

9. The vacuum cleaner construction as claimed in claim 1 wherein said deflector includes a sidewall depending from said bottom pan assembly and a bottom wall depending from said sidewall and said bottom pan assembly, said bottom pan assembly including a water chamber, said bottom wall including a central opening for communicating working air from said air inlet aperture to said water chamber.

10. The vacuum cleaner construction as claimed in claim 1 wherein a secondary filter is received on an annular receiving member depending from said lower motor support assembly.

11. In a vacuum cleaner having an upper housing and a lower housing, said lower housing having a working air inlet, said upper housing having a by-pass type blower motor and a working air inlet, the improvement comprising:

a water filter system comprising a working air inlet deflector in association with said working air inlet, a bottom pan assembly included in said lower housing and including a preselected amount of water for water filtering of working air and, a static water separator element fixed relative to said working air inlet for separating water from the working air and communicating the working air from said lower housing to said upper housing and said working air outlet; said water separator element having a bottom wall generally positioned at the water level of the pan assembly, an air porous portion and a generally water non-porous portion for separating water from said working air.

12. The improvement as defined in claim 11 wherein said air-porous portion faces generally away from said deflector.

13. The improvement as defined in claim 11 wherein said air-porous portion is sized relative to an inlet air aperture of said bypass type blower motor to regulate working air velocity through said air-porous portion to a preselected level whereby water is filtered from said working air by said separator element during operation of said vacuum cleaner.

14. The improvement as described in claim 11 wherein said deflector includes a bottom wall contiguous to the water level of said bottom pan assembly, said bottom wall including a working air outlet port for communicating the working air to said bottom pan assembly.

15. The improvement as described in claim 14 wherein said bottom wall is configured to direct the working air from said deflector bottom wall air outlet port through the water of said bottom pan assembly over the extent of said bottom wall.

* * * * *